US005234347A

United States Patent [19]

Kang

[11] Patent Number: 5,234,347

[45] Date of Patent: Aug. 10, 1993

[54] ROTATABLE CONNECTOR FOR TELEPHONE TRANSMITTER

[76] Inventor: Steve Kang, No. 49, Lane 81, Lee Sinn Road, Sec 2, Sanchung City, Taipei Hsien, Taiwan

[21] Appl. No.: 985,580

[22] Filed: Dec. 3, 1992

[51] Int. Cl.[5] ..... H01R 39/00

[52] U.S. Cl. ..... 439/26; 439/22; 439/676

[58] Field of Search ..... 439/13, 21, 22, 26, 439/28, 676

[56] References Cited

U.S. PATENT DOCUMENTS

| | | | |
|---|---|---|---|
| 2,265,846 | 12/1941 | Krantz | 439/26 |
| 4,673,228 | 6/1987 | Ditzig | 439/21 |
| 5,106,306 | 4/1992 | Ditzig | 439/676 X |

*Primary Examiner*—Eugene F. Desmond

*Attorney, Agent, or Firm*—Notaro & Michalos

[57] ABSTRACT

A rotatable connector for telephone transmitter, especially one which prevents the transmitter conductor from twisting, includes: a housing; a clip connecting plug for inserting into the transmitter; a rotation seat for inserting and placing into the housing and connecting with an extension conductor to electrically connect with the clip connecting plug; some sets of annular guide pieces composed of some semi-circular piercing guide pieces and some semi-circular guide pieces being fixed onto the rotation seat; and a jack for transmitter conductor being fitted in the housing and having some electrically conducting spring strips embedded thereon; In this structure, the jack for transmitter conductor can rotate freely relative to the rotation seat, while still keeps the spring strips in electric connection with the annular guide pieces.

1 Claim, 4 Drawing Sheets

ROTATABLE CONNECTOR FOR TELEPHONE TRANSMITTER

BACKGROUND OF THE INVENTION

1. Field of the Invention

The present invention relates to a rotatable connector for telephone transmitter, and especially relates to a rotatable connector for connecting between the transmitter conductor and the transmitter to effectively prevent the transmitter conductor from twisting.

2. Description of the Prior Art

The body of a telephone and the transmitter are normally connected to each other by a coiled conductor with the both ends of which each having a clip connecting plug; When the transmitter is not in use, the length of the conductor can be shortened by the automatic winding action of the elastic coiled conductor. While the coiled conductor will be over twisted due to the frequent changing of the relative positions between the telephone body and the transmitter in frequent uses of the transmitter; Such over twisting coiled conductor leads to the inconveniency of use, and the over twisting phenomenon after a long period of use will render the coiled conductor to yield an elastic fatigue state and further lose the proper recovering function and thus affect the electrical connecting capability, this can greatly disgrade the communication quality.

SUMMARY OF THE INVENTION

The object of the present invention is to provide a rotatable connector for telephone transmitter which can effectively prevent the coiled conductor from twisting.

Another object of the present invention is to provide an abovementioned type of rotatable connector for telephone transmitter which can be effectively reduced in its volume and thereby reduces the cost of manufacture.

Another object of the present invention is to provide an abovementioned type of rotatable connector for telephone transmitter which is provided with a soft extension conductor for connecting with a conventional clip connecting plug adapted to be inserted into any type of telephone, and which is thus widely useful.

A constructional device having the above stated functions includes: a housing; a clip connecting plug used for inserting into the transmitter; a rotation seat inserted into and placed in the said housing and connected to an extension conductor for electrically connecting with the clip connecting plug; a plurality of sets of annular guide pieces fixed on the abovementioned rotation seat and composed of a plurality of semi-circular piercing guide pieces and a plurality of semi-circular guide pieces; and a jack for the transmitter conductor fitted in the interior of the housing and embedded with a plurality of electrically conducting spring strips. With such a device, the jack for the transmitter conductor can be rotated freely relative to the rotation seat, and the conducting spring strips embedded on the said jack can maintain a relatively constant electric connection state with the annular guide pieces, this thus allows the relative rotation between the transmitter conductor and the clip connecting plug inserted in the transmitter, and further effectively prevents the transmitter conductor from twisting after the transmitter being frequently used in a long period, and the device thereby is practically useful.

BRIEF DESCRIPTION OF THE DRAWINGS

The structural features and the practical functions of the present invention is now described in detail as followings referring to the accompanied drawings, as can help to understand it.

In the drawings.

DETAILED DESCRIPTION OF THE PREFERRED EMBODIMENT

Figure 1:
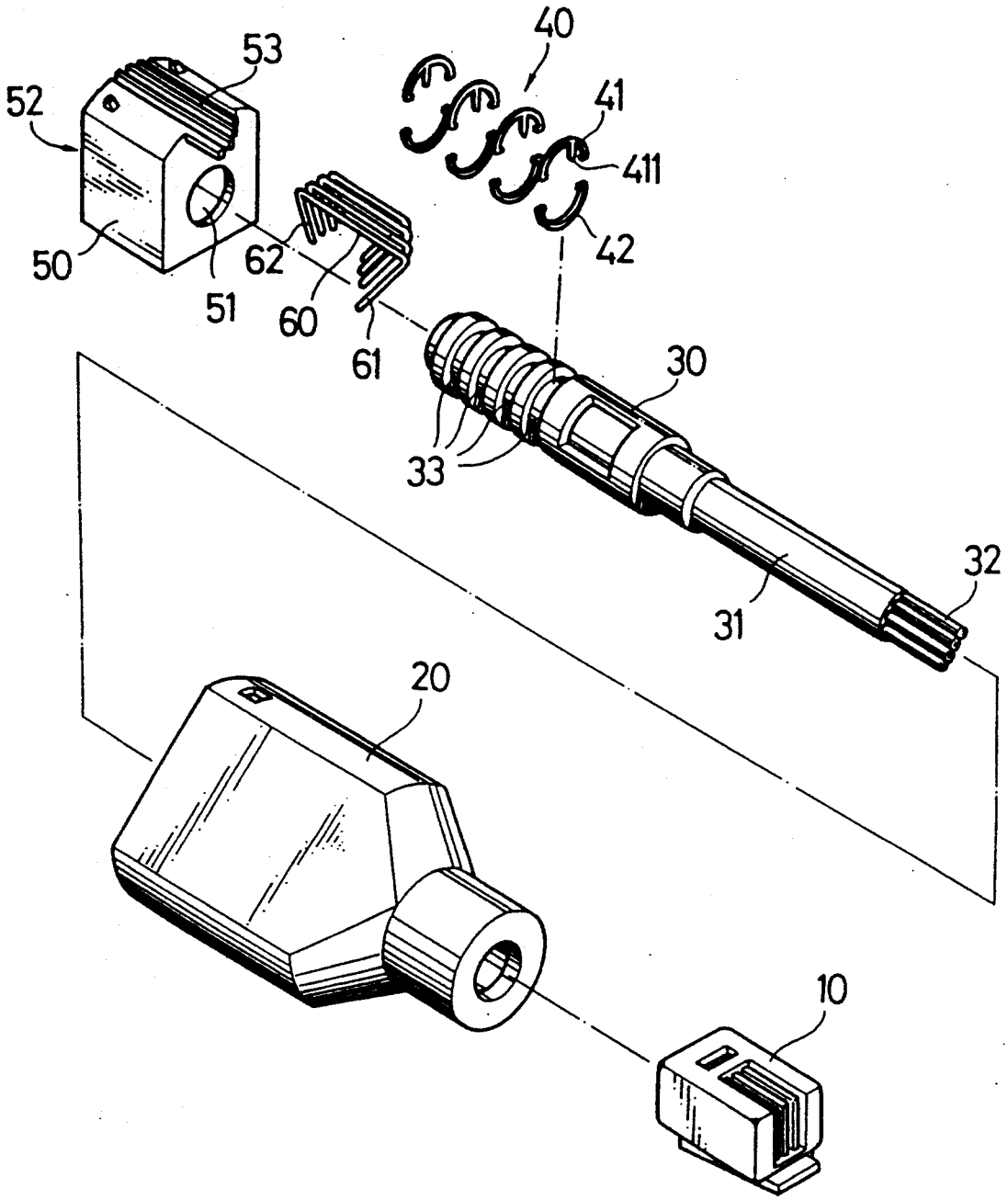
FIG. 1 is an anatomic stereoscopic view of the present invention.
Figure 5:
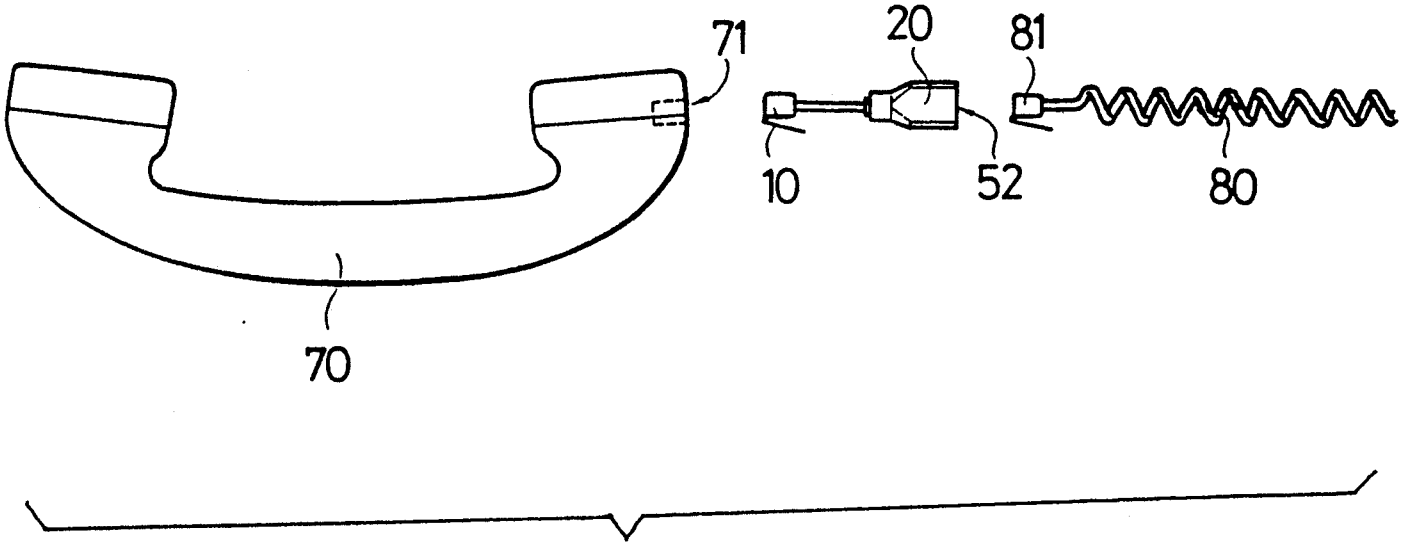
FIG. 5 is a schematic view showing the present invention being used to connect between a conventional telephone transmitter and a conventional transmitter conductor.

Referring to FIG. 1, the structure of the present invention is comprised of:

Clip connecting plug: used for inserting into a jack 71 in the transmitter 70 of a telephone to form the electric connection with the transmitter 70 (also referring to FIG. 5).

Housing 20: the interior thereof being hollowed and through, thus allowing the rotation seat 30 (to be stated latter) to be inserted and placed therein, and allowing the fitting of the jack for the transmitter conductor 50 to be stated latter.

Rotation seat 30: a soft extension conductor 31 extending forwardly being provided therein and normally having four core wires 32 in it, and four annular grooves 33 provided independently and serially spaced in equal distance being provided on the rear end thereof.

Annular guide pieces 40: being four sets totally, and being composed of four semi-circular piercing guide pieces 41 having a plurality of stings 411 in different positions, and also composed of four semi-circular guide pieces 42; these semi-circular piercing guide pieces 41 being embedded respectively in the corresponding one of the annular grooves 33 of the abovementioned rotation seat 30, and piercing through the plastic surface layer of the rotation seat 30 by the stings 411 in different positions, thus forming the electric connection state respectively with each of the four core wires 32 (as shown specifically in FIG. 4), while the semi-circular guide pieces 42 being closed to form therewith four annular guide pieces 40 embedded in the annular grooves 33 and electrically connecting with the four core wires 32 respectively.

Jack 50 for transmitter conductor: a central bore 51 being provided on the front face thereof for insertion of the end of the abovementioned rotation seat 30, and a socket 52 being provided on the rear face thereof for insertion of the transmitter conductor 80 (also referring to FIG. 5), moreover, on the top end of the body thereof four parallel slots 53 being provided and spaced serially in equal distance.

Electrically conducting spring strips 60: the lengths of all the four conducting spring strips 60 are different from one another, and each having a front end 61 and a rear end 62 all bending downwards respectively; being embedded in the four parallel slots 53 to the abovementioned jack 50 for the transmitter conductor respectively, meanwhile the ends 62 thereof extending into the socket 52 to form the electric connection with the conductor plug 81 of the transmitter 70 when the latter inserts into the socket 52.

Figure 2:
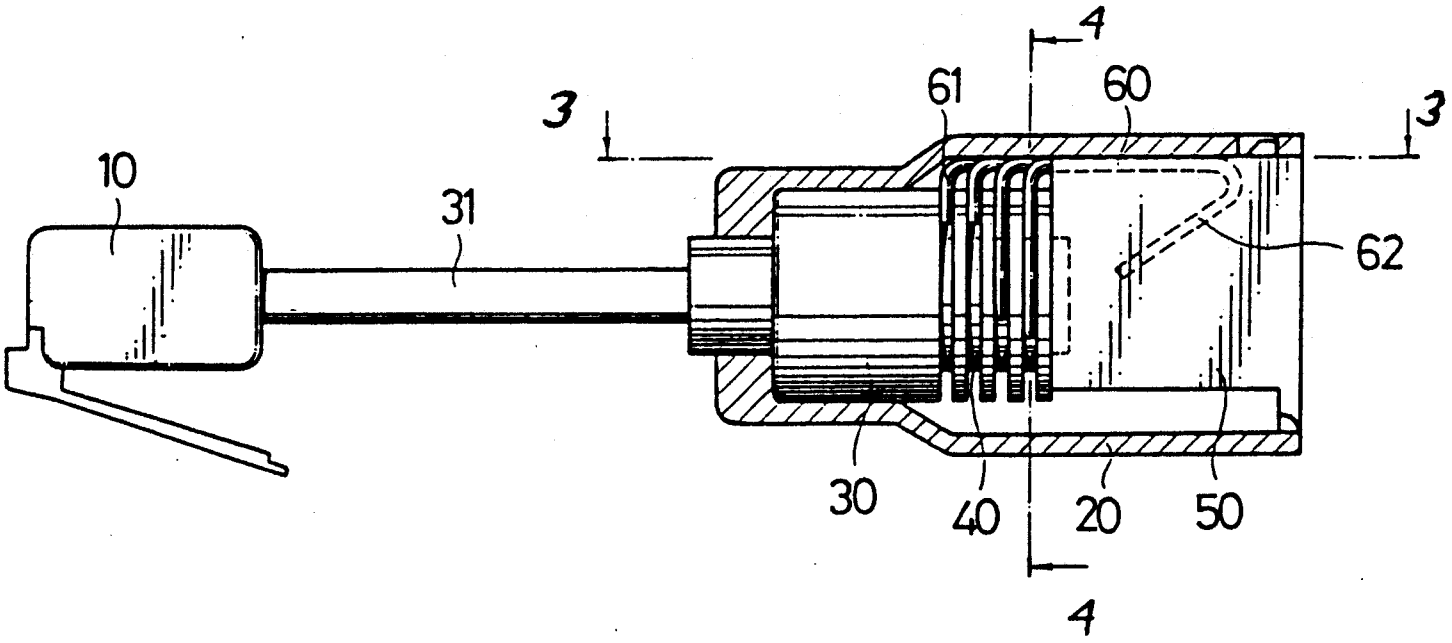
FIG. 2 is an assembled sectional view of the present invention.
Figure 4:
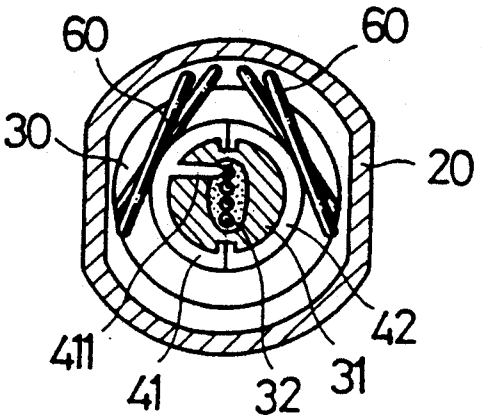
FIG. 4 is a sectional view of the present invention taken from the section line 4—4 in FIG. 2.
Figure 3:
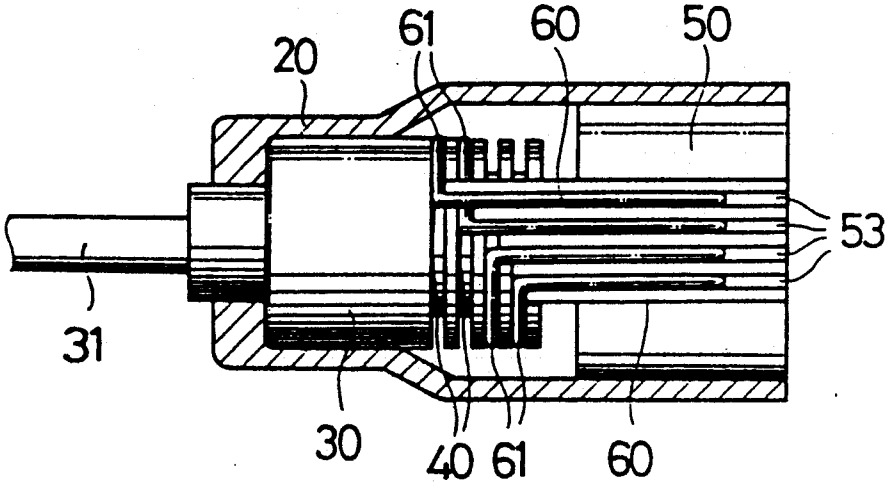
FIG. 3 is a sectional view of the present invention taken from the section line 3—3 in FIG. 2.

According to the aforesaid structure, and referring to FIGS. 2-4, the combination of the present invention is completed by inserting the rotation seat 30 into the housing 20 from the rear thereof to let the extension conductor 31 reveal out from the front end of the housing 20 and to let the four core wires 32 form the electric connection with the clip connecting plug 10, and then fitting the jack 50 for the transmitter conductor into the housing 20 (from the rear thereof) to joint integrally with it. In this combination, the front ends 61 of the four conducting spring strips 60, which are different in length with one another and thereby the ends 61 thereof are each located in a different position on the jack 50 for the transmitter conductor, exactly form tangentially with the four annular guide pieces 40 the electric connection respectively; Meanwhile, in such a combination, the housing 20, the jack 50 for the transmitter conductor and the conducting spring strips 60 are fixedly coupled to form one group (referred to as group A), while the clip conducting plug 10, the rotation seat 30 (including the extension conductor 31 and the core wires 32), and the annular guide pieces 40 are fixedly coupled to form another group (referred to as group B); Group A is used to connect the coiled conductor 80 for the transmitter, group B is used to connect the transmitter 70 (as shown in FIG. 5), while groups A and B can be rotated freely relative to each other, and no matter how they rotate, the four conducting spring strips 60 thereon always keep the electric connection state with the four annular guide pieces 40.

With such a structure stated above, the present invention has the following improvements over the conventional direct connecting mode between the transmitter and the coiled conductor for the transmitter:

1) It surely prevents the coiled conductor of the transmitter from twisting, and further clears the problems of inconveniency in use, elastic fatigue created in the coiled conductor, and bad electric contact, all produced from twisting thereof.
2) It occupies a small volume and makes a low cost in manufacturing, and thus is able of reducing about 40% of manufacturing cost as is beneficial to the customers.
3) the soft extension conductor of it can suit to the jack of any type of telephone transmitter, therefore it is versatile in practical application.

In conclusion, the present invention not only is innovative but also provides the above mentioned improvements in functions; Therefore it is provided with the novelty, improvement, as well as practically useful value. The present invention may assume numerous forms and is to be construed as including all modifications and variations falling within the scope of the appended claims.

What is claimed is:

1. A rotatable connector for telephone transmitter, it is comprised of the following members:

a clip connecting plug, a housing, a rotation seat, a plurality of annular guide pieces, a jack for transmitter conductor and a plurality of conducting spring strips; and is characterized in that:

Said housing being hollowed and through to allow said rotation seat to be inserted and placed therein, and to allow the fitting of said jack for transmitter conductor;

Said rotation seat being provided with a soft extension conductor extending forwardly therein and having a plurality of core wires in it, also being provided on its rear end with a plurality of independent annular grooves serially spaced in equal distance; said rotation seat inserting into said housing from the rear thereof to let said extension conductor reveal out from the front end thereof, while the front end of said extension conductor being able to form the electric connection with said clip connecting plug;

Said annular guide pieces being the same in number of sets as that of said annular grooves, each set of said annular guide pieces being composed of a semi-circular piercing guide piece, having thereon a sting, and a semi-circular guide piece, and each of said sting on said respective semi-circular piercing guide piece being on a different position respectively; each set of said annular guide pieces being embedded in one of said annular grooves respectively, while each said sting piercing through the plastic surface layer of said rotation seat to form the electric connection with one of said core wires respectively;

Said jack for transmitter conductor having a central bore in the front face thereof, and having a socket for insertion of the transmitter conductor on the rear face thereof, also having a plurality of parallel slots spaced serially in equal distance on the top end of the body of said jack, with the number thereof equal to that of said annular guide pieces; said jack being fitted in the interior of said housing;

Said conducting spring strips being the same in number as that of said sets of annular guide pieces, the lengths of said spring strips are different with one another, said strips each having a front end and a rear end bending downwards respectively; said strips being each embedded in one of said parallel slots on said jack for transmitter conductor respectively, so as to let said front ends each be electrically connected with one of said sets of annular guide pieces tangentially;

Wherein said housing, jack for transmitter conductor and electrically conducting spring strips being coupled as a group, while said rotation seat, annular guide pieces and clip connecting plug being coupled as another group, said groups being able of relative free rotation while still keeping the electric connection therebetween.

* * * * *